US008752921B2

(12) United States Patent
Görz et al.

(10) Patent No.: US 8,752,921 B2
(45) Date of Patent: Jun. 17, 2014

(54) REFRIGERATOR OR FREEZER COMPRISING A REINFORCEMENT FRAME

(75) Inventors: Alexander Görz, Aalen (DE); Hans-Philipp Reitz, Giengen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 12/085,068

(22) PCT Filed: Oct. 20, 2006

(86) PCT No.: PCT/EP2006/067635

§ 371 (c)(1),
(2), (4) Date: May 15, 2008

(87) PCT Pub. No.: WO2007/062924

PCT Pub. Date: Jun. 7, 2007

(65) Prior Publication Data

US 2009/0284116 A1 Nov. 19, 2009

(30) Foreign Application Priority Data

Nov. 30, 2005 (DE) ..... 10 2005 057 150

(51) Int. Cl.
*A47B 96/04* (2006.01)

(52) U.S. Cl.
USPC ..... 312/406.2; 312/401; 312/405

(58) Field of Classification Search
USPC ..... 312/406, 406.1, 406.2, 405, 401; 62/265; 220/592.02, 592.05–592.09, 220/592.1
See application file for complete search history.

(56) References Cited

U.S. PATENT DOCUMENTS

| | | | | |
|---|---|---|---|---|
| 2,332,195 | A | 10/1943 | Bergstrom | |
| 2,675,687 | A * | 4/1954 | Philipp | 220/592.05 |
| 2,845,321 | A | 7/1958 | Saunders et al. | |
| 2,988,414 | A | 6/1961 | Crowe et al. | |
| 3,006,708 | A * | 10/1961 | Saunders et al. | 312/406.2 |
| 4,416,086 | A | 11/1983 | Nickrasz | |
| 4,632,470 | A | 12/1986 | Jenkins et al. | |
| 4,706,363 | A | 11/1987 | Taylor, Jr. | |
| 4,822,117 | A | 4/1989 | Boston, Jr. | |
| 4,958,890 | A | 9/1990 | Anderson et al. | |
| 5,897,181 | A | 4/1999 | Avendano et al. | |
| 5,899,546 | A * | 5/1999 | Avendano et al. | 312/406.2 |

(Continued)

FOREIGN PATENT DOCUMENTS

| | | |
|---|---|---|
| DE | 20 2004 007 524 U | 8/2005 |
| EP | 0 668 476 | 8/1995 |

(Continued)

OTHER PUBLICATIONS

International Search Report PCT/EP2006/067635.

*Primary Examiner* — Hanh V Tran
(74) *Attorney, Agent, or Firm* — Nixon & Vanderhye P.C.

(57) ABSTRACT

A refrigeration device, in particular a refrigerator and/or freezer. In an exemplary embodiment, the device includes a housing with a top, a base, lateral walls and at least one door that is attached by hinges. A reinforcement frame, to which the door is attached by the hinges, is provided on the housing. The invention is characterized in that with the aid of the reinforcement frame a particular mechanical stability is achieved for the housing, allowing even large and heavy do ors to be reliably attached and remain operationally safe.

18 Claims, 13 Drawing Sheets

(56) References Cited

U.S. PATENT DOCUMENTS

| | | | | |
|---|---|---|---|---|
| 6,000,771 | A | 12/1999 | Wissinger et al. | |
| 6,036,293 | A * | 3/2000 | Anell et al. | 312/406 |
| 6,065,612 | A * | 5/2000 | Rinderer | 312/265.1 |
| 6,138,341 | A | 10/2000 | Barroero et al. | |
| 6,773,082 | B2 * | 8/2004 | Lee | 312/401 |
| 2003/0141793 | A1 | 7/2003 | Lee | |
| 2004/0012315 | A1 | 1/2004 | Grace et al. | |
| 2006/0017361 | A1 * | 1/2006 | Rendel et al. | 312/405 |

FOREIGN PATENT DOCUMENTS

| | | |
|---|---|---|
| EP | 0 825 400 | 2/1998 |
| FR | 1.061.618 | 4/1954 |
| FR | 2 365 087 | 4/1978 |
| GB | 853100 | 11/1960 |
| GB | 1 383 902 | 2/1975 |

* cited by examiner

Fig. 4
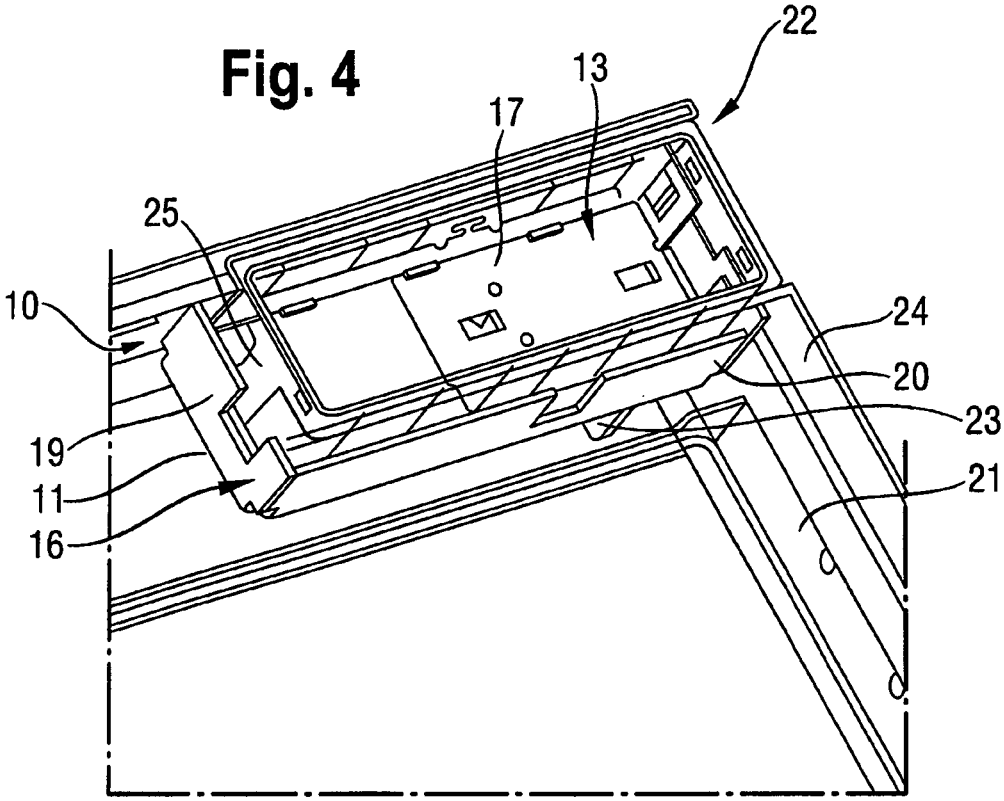
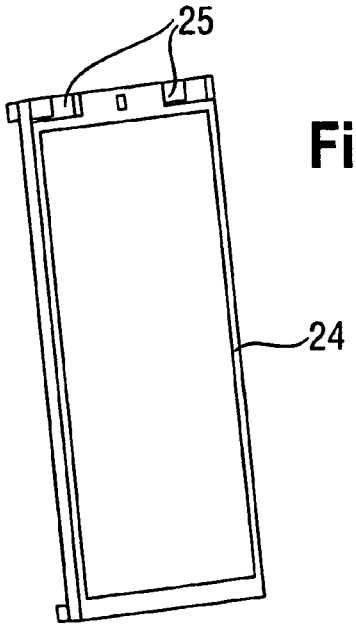
Fig. 5

REFRIGERATOR OR FREEZER COMPRISING A REINFORCEMENT FRAME

BACKGROUND OF THE INVENTION

The invention relates to a refrigeration device, especially a refrigerator and/or freezer, comprising a housing with a top, a base, lateral walls and at least a one door attached by hinges.

In practice it can be necessary to integrate refrigeration devices such as refrigerators and/or freezers for example as built in devices into a fitted unit, with a number of individual devices also having to be combined together in order to provide refrigerator or freezer combinations. It should be noted here that the individual devices can have different widths, with the widths of over 80 cm in particular imposing special demands on the mechanical stability of the individual devices and on the device combination so that as a rule constructional measures are required. The aim of making available fully-integrated built-in devices which cover the largest possible number of kitchen situations also leads a hinge kinematics having to be provided which demand a hinge with comparatively large dimensions. This is especially the case if multi-link hinges are used as the hinges. Because of the necessary kinematics in the horizontal plane, the hinge is constructed as a rule such that space problems arise when it is attached to a carcass of the unit wall.

The devices and thereby the device doors can in some cases the very wide, i.e. over 85 cm, with the door being very heavy because of its size and the necessary technical deflection. The door can also be loaded with a significant volume of stored goods in the door compartments. In addition a very heavy unit front can also be provided on the door after the device is built in, of which the weight must likewise be carried by the door. Furthermore the hinge can have a very wide overhang in its opened position so that as a rule large loads occur both at the hinge and also at the housing-side connection point.

BRIEF SUMMARY OF THE INVENTION

The object of the present invention is to specify a refrigeration device, especially a refrigerator and/or freezer, which offers a flexibility in the dimensioning of the width without adverse effects with regard to the stability during use of the refrigeration device.

In accordance with the invention this object is achieved by the refrigeration device as specified in the independent claim. Further advantageous embodiments and developments, able to be employed individually in each case or to be suitably combined in any way with each other are the subject matter of the dependent claims.

The inventive refrigeration device, especially the refrigerator and/or freezer, comprises a housing with a top, a base and lateral walls and further comprises at least one door attached by hinges, with a reinforcement frame at being provided on a housing to which the door is attached by the hinges.

The stability problem mentioned is especially resolved by the fact that in a front area of the device carcass, i.e. in an area in which the hinges are fitted, a stable element which generates rigidity is introduced in the form of a frame. The reinforcement area stabilizes the refrigeration device, in which case it especially transmits the forces operating through the door or on the door over a large area or as evenly as possible to the housing. The reinforcement frame can be a multi-part construction which is essentially constructed from metal profiles. The reinforcement frame is especially made of steel. In particular the mechanical stability of the refrigeration device is stabilized by the reinforcement frame in a front part of the housing, i.e. in the part which is adjacent to the door.

The reinforcement frame is especially attached to the top and to the base and/or to the lateral walls. In particular the components of the housing, i.e. the top and the base, which are not thermally decoupled and are therefore warm, are connected to the reinforcement frame. The connection between the reinforcement frame and the housing can be made using jointing technologies, especially using rivets, screws, welds, pressing in etc. The stabilizing effect of the reinforcement frame is transferred via these components to the housing as a whole, especially to the rear wall. Since the lateral walls, especially when the device is used as a built-in device, are as a rule colder than the ambient temperature, it is advantageous if, in the connection between the reinforcement frame and the lateral walls, a thermal insulation is arranged between the reinforcement frame and the lateral walls in order to reduce a heat transfer from the reinforcement frame through to the lateral walls. This improves the thermal insulation and thereby the efficiency of the refrigeration device and a layer of air located in front of the lateral walls can act as a further insulation layer. The layer of air can for example be formed by a gap between the walls of a fitted unit compartment and the refrigeration device.

In one embodiment the reinforcement frame runs around the housing and along the top, the base and the lateral walls. It is preferable for the reinforcement frame to be sealed all around. The reinforcement frame is advantageously located in a door-side area of the refrigeration device.

In a particular embodiment the reinforcement frame features at least one, especially at least two, especially at least four mountings for the hinges. It is advantageous in this case for the mountings to be provided both at a first, for example left-hand door side and at a second for example right-hand door side, to make it possible to switch the hinges to a different side. With the aid of the mounting arranged on both sides of the reinforcement frame a door which opens to the left can be converted into a door which opens to the right. As a rule a door is attached with the aid of two hinges arranged a different heights. For particularly heavy doors however a least three or at least four hinges can be required. By arranging the mountings for the hinges on the reinforcement frame, an especially stable, robust and torsionally-rigid transmission of the forces acting through the door to the housing can be realized.

Advantageously the mounting forms a pocket which accepts the hinge. The pocket makes an especially stable attachment of the hinge to the reinforcement frame possible. In particular the pocket prevents the hinge from shaking loose or twisting. The hinge is additionally fixed by the pocket. It is of advantage for the pocket to accommodate at least 10% of the volume of the hinge, especially at least 50%, preferably at least 80%, especially preferably at least 90%.

With the aid of the pocket the hinge can also be partly sunk into the frame which can be advantageous with hinges of large dimensions. With the aid of the pocket the hinges can be integrated into the device carcass which allows the hinge to be recessed into the housing.

In a particular embodiment the mounting includes a base part and a screw plate with the base part and the screw plate especially being joined to form a box, with the box featuring a surface to accommodate the hinge, a rear side of the box lying opposite the surface and box side walls.

The box serves to ensure an especially high torsional stiffness of the mounting. The base part and the screw plate can for example be joined firmly to each other by welding, riveting, pressing in etc. The box form also leads to a comparatively large outer surfaces being produced which can be used to connect the box to the reinforcement frame. These and connection parts lie behind the contact plane for the hinges so that the mounting does not collide with the hinge. The size when viewed from the front can thus be designed comparatively small. In a modification a corresponding profile element can also be used instead of the box, which ensures an appropriate torsional stiffness or facility for connection at the sides.

Advantageously the box is attached by at least one, preferably by two of its box side walls to the reinforcement frame. The attachment of the box by its box side walls to the reinforcement frame enables the reinforcement frame to be taken especially close to the door by which an especially robust stabilization of the door-side area of the refrigeration device is realized.

In a special design the reinforcement frame features a first mounting for hinging the door on a first lateral wall and a second mounting for hinging the door on a second lateral wall.

The first mounting can be provided to the left on the refrigeration device and the second mounting can be provided to the right on the refrigeration device. Basically it is also possible to provide a number of doors on a refrigeration device, which are either arranged above one another or next to one another. For example the refrigeration device can be opened by a double door, i.e. a first door on the left and a second door on the right.

In an advantageous embodiment frames are assembled from a number of profile bars, especially U- or L-profiles and corner connectors, with the profile bars being connected to each other by the corner connectors. The profile bars can be connected to the corner connectors using jointing techniques, especially by welding, riveting, pressing in etc.

The reinforcement frame can especially be attached to the housing during the assembly of the refrigeration device. For this purpose of the reinforcement frame is produced as a separate component and is subsequently joined to the housing.

The corner connectors in particular feature force distribution elements through which force exerted on the reinforcement frame is transferred to the housing, with a force distribution element especially having a contact surface to the housing which amounts to at least 15 $cm^2$, especially at least 25 $cm^2$, preferably at least 50 $cm^2$. The forces are directed by the force distribution element over a large surface into the housing or transferred to the housing Force distribution elements can be provided as metal plates. The contact surface should extend over the largest possible area. It should however not be larger than 500 $cm^2$.

The reinforcement frame can be able to be connected to a front frame of the refrigeration device. The front frame serves to thermally insulate the interior of the refrigeration device, which is delimited by metallic inner walls, from the warm outer sides, such as the lateral walls, the top and the base for example. With the aid of the front frame which is usually made of plastic, a heat bridge between the metallic inner walls and the warm outer walls is avoided. The reinforcement frame helps to reduce or to remedy the instability of the housing caused by the front frame, in that the lateral walls or the top and the base are stabilized by it. The front frame of the refrigeration device which is comparatively unstable because of the material chosen for it is stabilized by the reinforcement frame. In this manner the front frame can be produced in a comparatively simple way.

Advantageously the reinforcement frame features a positioning element for positioning the front frame. The positioning element makes the assembly of the refrigeration device significantly simpler since the spatial relationship between the reinforcement frame and the front frame is defined by it. The positioning element can be a support foot at and/or a latching element with which the reinforcement frame and the front frame are connected to each other.

Advantageously the front frame features a hinge box. With the aid of the hinge box, which accommodates the hinge, the front frame is aligned precisely relative to the hinges. For this the mounting for the hinges is designed so that there is sufficient space for the hinge box. The hinge box, like the front frame, is made out of plastic. Advantageously the hinge box is gripped by the pocket.

The reinforcement frame can feature a transverse bar which subdivides the reinforcement frame into two adjacent frames. The reinforcement frame is additionally stabilized by this. A transverse bar is especially advantageous for refrigeration devices with two doors arranged next to one another or above one another.

In a special embodiment of the invention a lower hinge mounting is provided which can be attached to the refrigeration device from one below and can be switched from one door side to another door side.

In the upper and central area the hinge pockets integrated into the carcass are not critical: The necessary enlargement of the insulation in the area of the pockets to accept a minimum insulation, although it leads to an undercut in the device carcass, does not however represent any disadvantage during use, since refrigeration technology components are always located behind the undercut and the area occupied by technical components is of little use to user, so that other areas able to be better used by the user remain free.

In the lower area such undercutting is rather more critical since cooling components are not effectively placed there in a comparable way and storage shelves should be located there. A pull-out style storage shelf must always be placed so that it would lie above such a lower undercut. Storage space located below a classical pull-out storage shelf is not really usable for a customer.

Thus for the lower hinge by contrast with the upper hinges, an attachment below the thermally-insulated device carcass in the area of the plinth is preferred. Since the plinth as a rule extends behind the foamed carcass in any event, the hinge located there also does not have to be recessed or only recessed to a small extent.

BRIEF DESCRIPTION OF THE DRAWINGS

Further details and specific embodiments, which can each be used individually or combined in any way with each other, are explained in greater detail with reference to the following drawing, and are not intended to restrict the invention but are merely designed as typical illustrations.

The figures show the following schematic diagrams.

DETAILED DESCRIPTION OF THE PRESENT INVENTION

Figure 1:
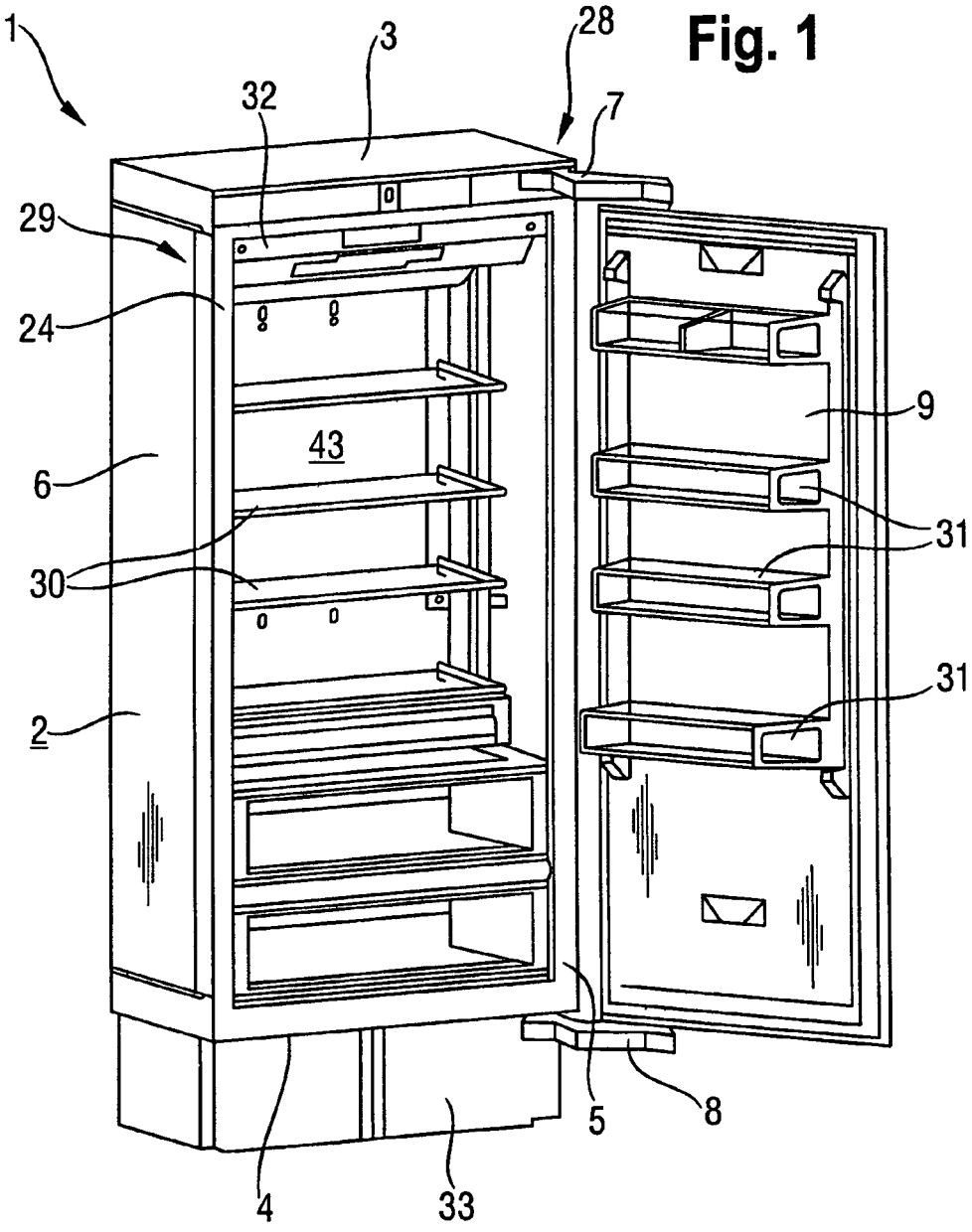
FIG. 1 an inventive refrigerator in a perspective angled view

FIG. 1 shows an inventive refrigeration device 1 with a housing 2, which comprises a top 3, a base 4, a first lateral wall 5 and a second lateral wall 6. The refrigeration device 1 features an interior 43 which can be closed or opened by a door 9. The door 9 has door compartments 31 and is attached by a first hinge 7 and a second hinge 8 to the housing 6. In the interior 43 shelves for holding goods (not shown) and an evaporator 32 for creating cold air are provided. The door 9 is attached on a first, right-hand door side 28. In a door-side area of the housing 2 a front frame 24 made of plastic is provided, which suppresses the conduction of heat from the comparatively warmer lateral walls 6, 7 of the top 3 or of the base 4 into the interior 43. The door 9 can be switched by converting the hinges 7, 8 to a second, right-hand door side 29.

Figure 2:
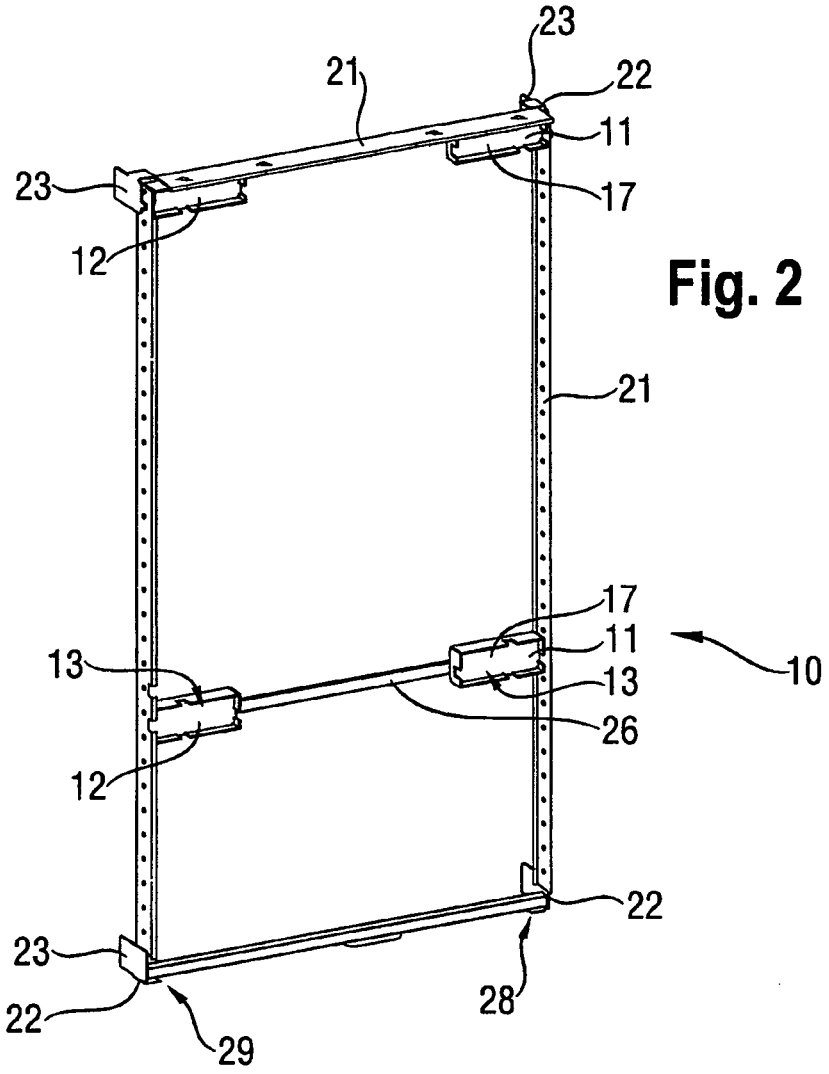
FIG. 2 and FIG. 3 different embodiments of a reinforcement frame used for an inventive refrigeration device, FIG. 4 a detailed view of a reinforcement frame as depicted in FIG. 2 or 3, FIG. 5 an embodiment of a front frame for an inventive refrigeration device, FIG. 6 a detailed view of the refrigeration device as depicted in FIG. 1, FIG. 7 a detailed view of a reinforcement frame as depicted in FIG. 2 or 3, FIG. 8 a further detailed view of a reinforcement frame, FIG. 9-11 different perspective views of a lower hinge mounting, FIG. 12 a perspective view of an upper or central hinge mounting, FIG. 13 the hinge mounting from FIG. 12 in a sectional view, FIG. 14 a housing of an inventive refrigerator in a perspective sectional view, FIG. 15 a further inventive refrigerator, FIG. 16 a perspective sectional view of a lateral wall with a reinforcement frame and an insulating strip, FIG. 17 a perspective sectional view of a rear wall with an insulating strip, FIG. 18 a perspective sectional view which shows the upper left corner of an inventive refrigerator.

FIG. 2 shows a perspective view of a reinforcement frame 10, which is used for strengthening the housing 2 in a door-side area. The reinforcement frame 10 is assembled from profile bars 21 and corner connectors 22 which are connected to each other using a jointing method. Attached to the reinforcement frame are first mountings 11 arranged on the first door side 28 and second mountings 12 arranged on the second door side 29. The mountings 11, 12 feature a mounting surface 17 to which the hinges 7, 8 can be attached. The mountings 11, 12 are embodied as pockets 13 and to at least partly firmly surround the hinges 7, 8, which prevents the hinges from shaking loose or from twisting. Force distribution elements 23 are provided at the corner connectors 22 which transfer the forces introduced into the reinforcement frame 10 to a housing 2. The reinforcement frame 10 is divided up by a transverse bar 26 so that an upper and the lower frame are formed which in each case correspond to the compartments of the refrigeration device 1.

Figure 3:
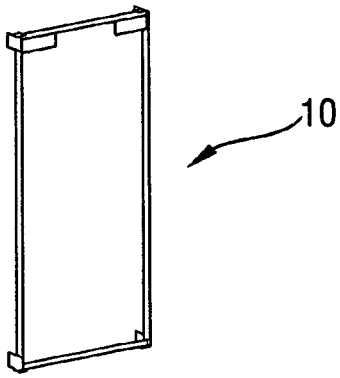

FIG. 3 shows a reinforcement frame 10 without such a transverse bar 26. With the aid of the reinforcement frame and 10 the housing 2 is stabilized in a door-side area and is designed with a greater torsional rigidity. The forces of wide and heavy doors 9 can especially be accommodated by said frame and transferred evenly to the housing 2.

FIG. 4 shows a detailed perspective view of a mounting 11 of the reinforcement frame 10, with the mounting 11 featuring the mounting surface 17 for the hinges 7, 8. The mounting 11 is designed as a box 16 with first box side walls 19 and second box side walls 20, with a pocket 13 being formed which accepts a hinge box 25 of the front frame 24 and the hinge 7, 8. The box 16 is connected with two of its side walls 19, 20 to the reinforcement frame 10, whereby an especially robust connection is obtained. The profile bars 21 are firmly connected to one another by the box 16 and the corner connectors 22. The corner connector 22 has a force distribution element 23 with which the reinforcement frame 10 is attached to the housing 2.

FIG. 5 shows the front frame 24 in a perspective angled view for the reinforcement frame as depicted in FIG. 3 with hinge boxes 25.

Figure 6:
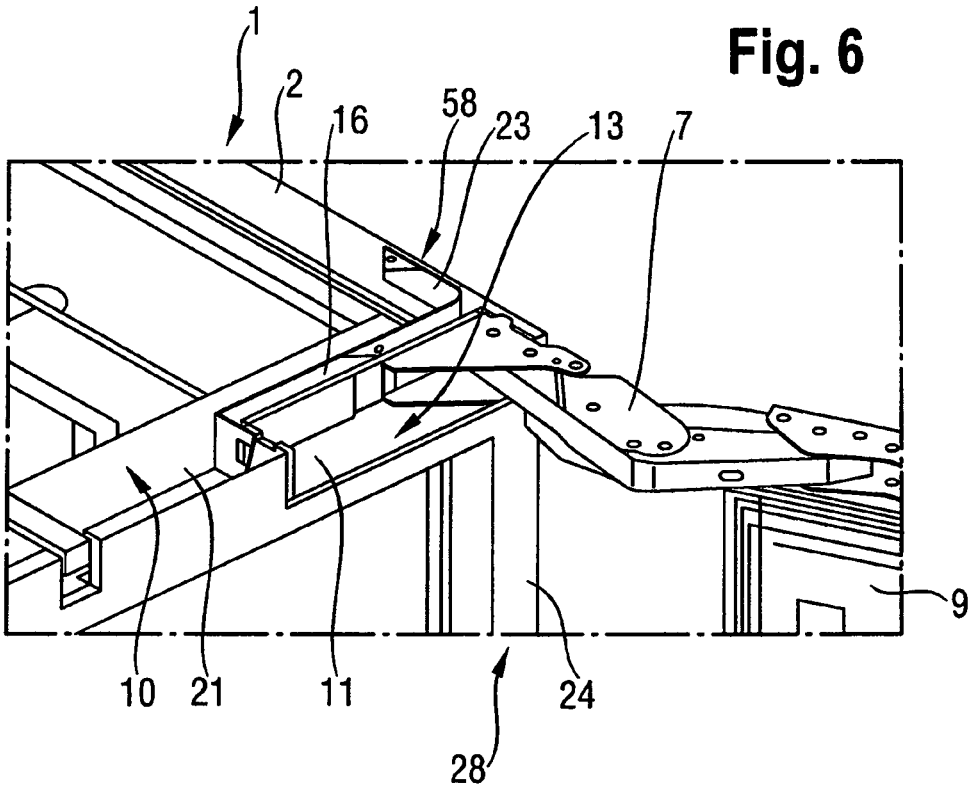

FIG. 6 shows a perspective angled view of an upper right hand corner of an inventive kitchen device 1, with the hinge 7 being recessed into the housing and integrated into the pocket 13. The pocket 13 is provided on the first mounting 11. The mounting 11 is especially strengthened by the box 16. The box 16 is also used to support the corner connectors 22 which connect the profile bars 21 of the reinforcement frame 10 to each other, in that the box is mechanically firmly connected on two of its sides 19, 20 to the profile bars 21. The reinforcement frame 10 is attached via a force distribution element 23 to the housing 2, to enable the force to be introduced over the largest possible area evenly into the housing 2 onto a surface of approximately 70 $cm^2$.

Figure 7:
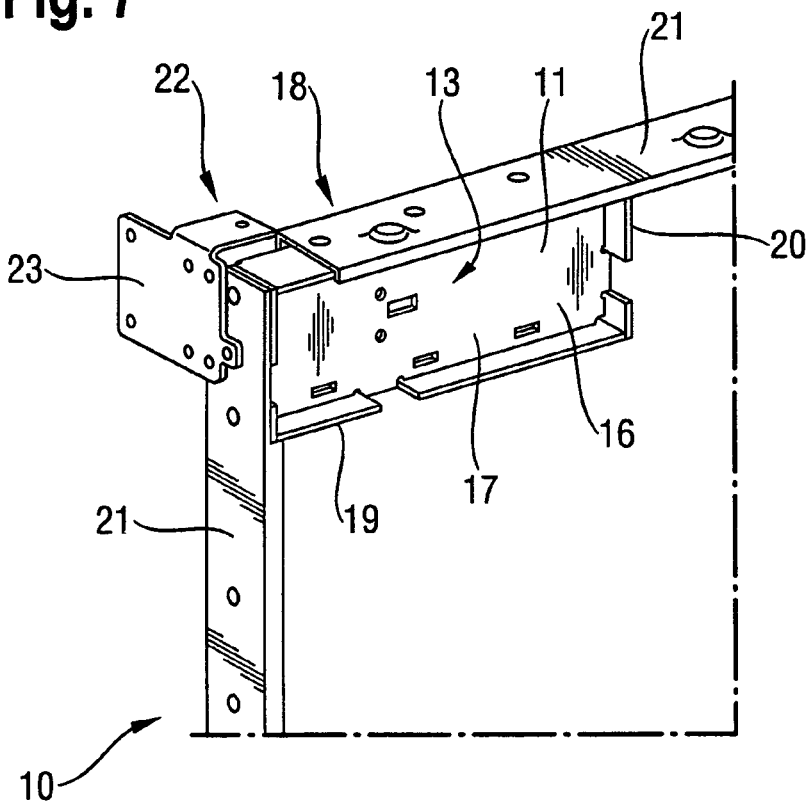

FIG. 7 shows a detailed perspective view of the reinforcement frame 10. The profile bars 21 are torsionally rigidly connected to each other by the corner connectors 22 and the box 16. The mounting 11 features the mounting surface 17 which is framed or enclosed by the box side walls 19, 20 so that a pocket 13 is formed. Attached to the corner connectors 22 is the force distribution element 23 with which the forces acting on the reinforcement frame are transferred as evenly as possible to the housing 2.

Figure 8:
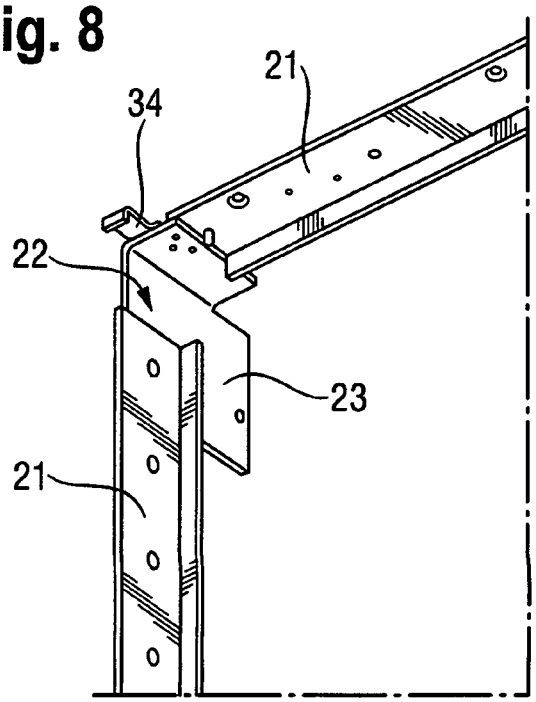

FIG. 8 shows an angled perspective view of a further embodiment of the corner connector 22 for connecting the profile bars 21 of the reinforcement frame 10, with a positioning element 34 for positioning at the front frame 24 relative to the reinforcement frame 10 being provided on the corner connector 22. With the aid of the positioning element 34 the reinforcement frame is arranged during installation of the refrigeration device 1 precisely in relation to the front frame 24.

Figure 9:
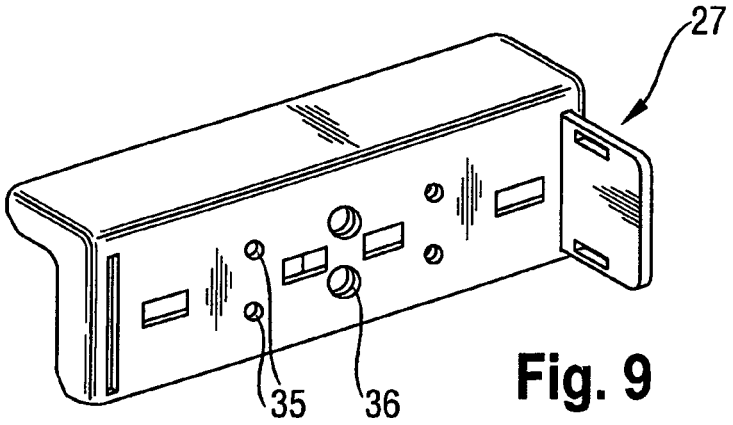
Figure 10:
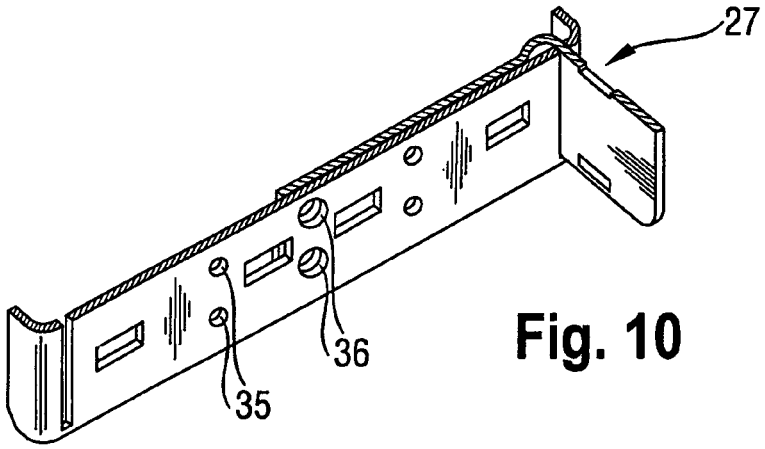
Figure 11:
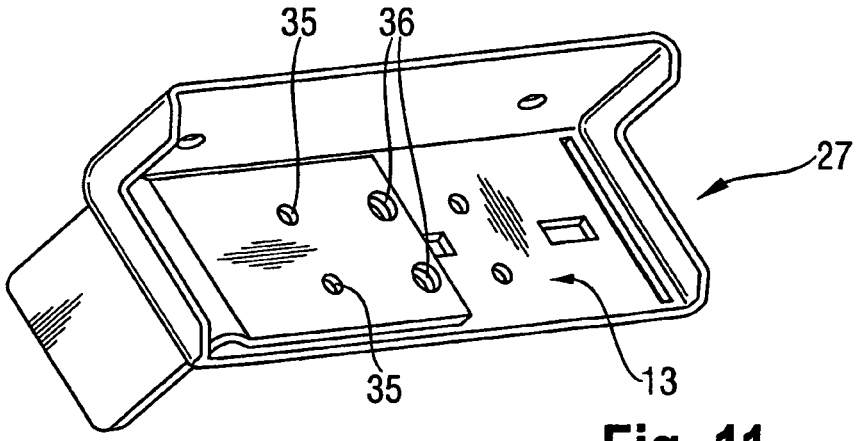

FIGS. 9-11 show different perspective views of a lower hinge mounting 27, which is attached in the area of the plinth 23 from below to the housing 2. FIGS. 9-11 here show the same lower hinge mounting 7 from different directions, with FIG. 10 being a sectional view. The lower hinge mounting 27, like the first 11 and second 12 mounting, features a pocket 13 which accepts the hinge 7, 8. The hinge 7, 8 is aligned with the aid of pins 35 and screwed in with the aid of threaded holes 26. The lower hinge mounting 27 can be converted from a first door side 28 to a second door side 29.

Figure 12:
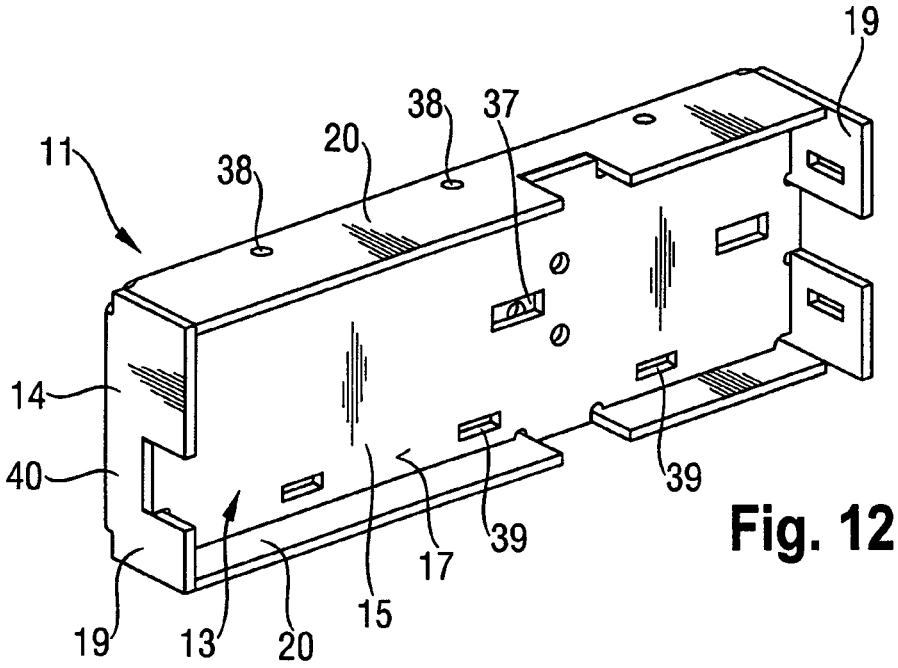
Figure 13:
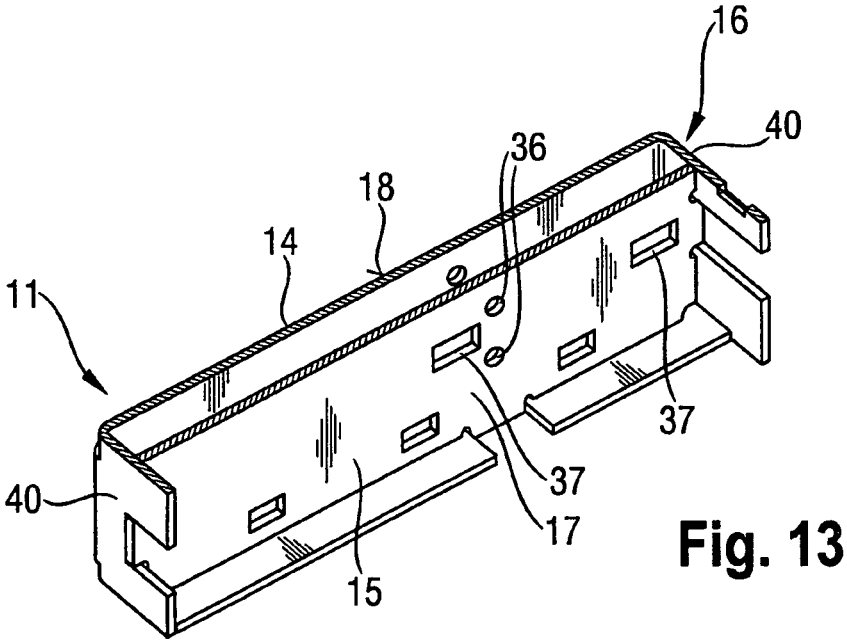

FIG. 12 shows a perspective angled view of a mounting 11, 12 for a hinge 7, 8 with a pocket, which is shown in FIG. 13 as a sectional view. The mounting 11 comprises a base part 40 and a screw plate 15 which are joined together to form the box 16. The first box side wall 19 and the second box side wall 20 form the pocket 13 with their edges 40 together with the mounting surface 17. The box 16 ensures an especially high torsional rigidity of the mounting 11 and the mounting 11 can be connected with the first box side wall 19 and the second box side wall 20 to the reinforcement frame 10. The mounting surface 17 of the mounting 11 has locating holes 37 for the hinge 7, 8, which simplifies installation of the hinge 7, 8. In addition the mounting surface 17 features second attachment elements 39 for connecting the mounting 11 to the hinge box 25, by which a positioning of the front frame 24 on the reinforcement frame 10 is simplified. With the aid of first attachment elements the box 16 is attached to the reinforcement frame 10 and, especially to the profile bars 21 or the corner connectors 22. The box 16 has a box rear side 18.

Figure 14:
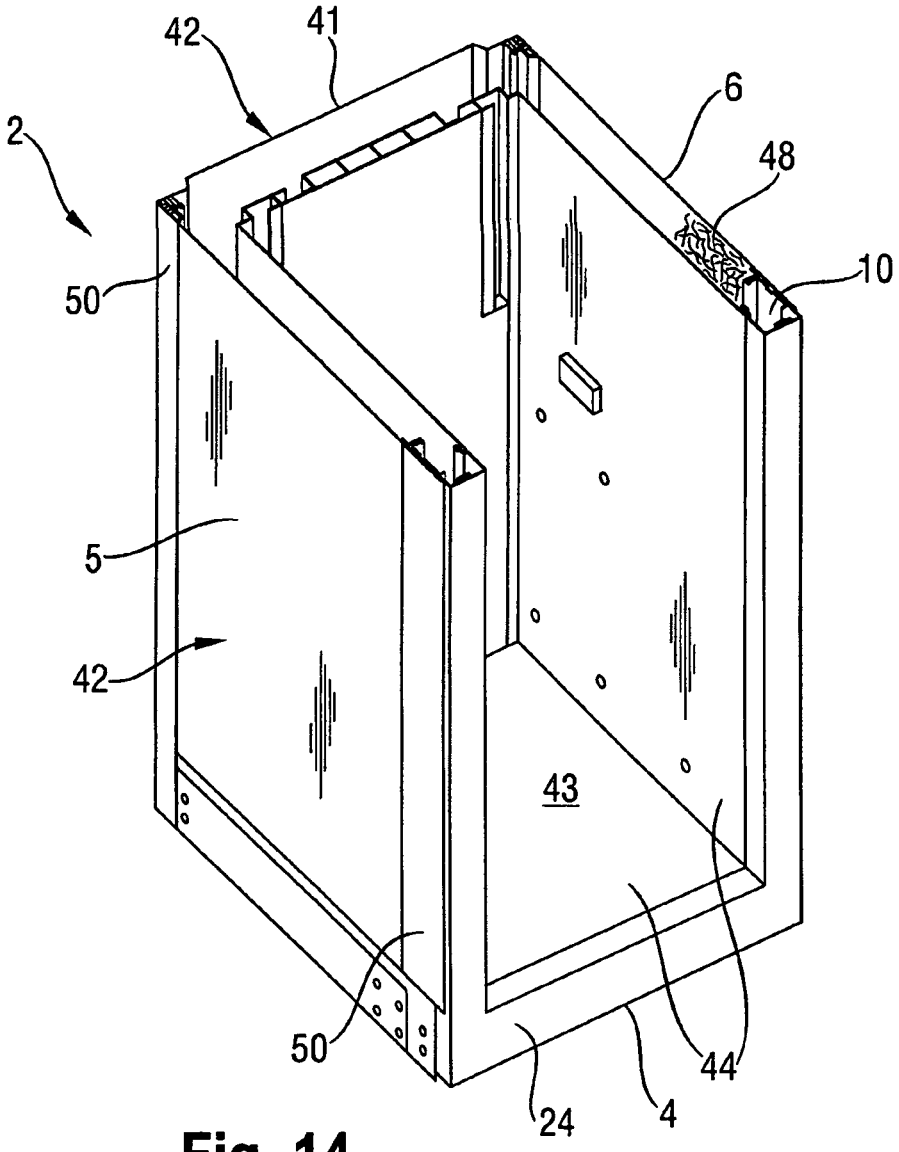

FIG. 14 shows a perspective sectional view of a further inventive refrigeration device 1 and shows that the front frame and 24 is attached by an insulating strip 50 to the first lateral wall 5 or the second lateral wall 6. The interior 43 of the refrigerator 1 features internal walls 44. The refrigeration device features a rear wall 41. The rear wall 41, the lateral walls 5, 6, the base 4 and the top 3 form outer walls 42 of the refrigeration unit 1. Between the inner walls 44 and the outer walls 42 an insulating foam 48 is provided for thermal insulation of the interior 43. The reinforcement frame 10 is used for a stabilization or stiffening of the housing 2 in a door-side area. The reinforcement frame 10 is however not connected directly to the lateral walls 5, 6 but is thermally insulated from the walls by an insulating strip 50. This makes it harder for heat to be conducted from the comparatively warm reinforcement frame 10 to the generally comparatively warm lateral walls 5, 6, which improves the energy utilization of the refrigeration device 1. The insulating strip 50 is made of plastic. The rear wall 41 is likewise thermally insulated from the lateral walls 5, 6 by insulating strips 50. The rear wall 41 is as a rule very much warmer than the lateral walls 5, 6, since the evaporator of the refrigeration device 1 is located as a rule on or at the rear wall 41 and heat is output at this point. The lateral walls 5, 6 cool down comparatively on the other hand as a result of the incomplete thermal decoupling by the insulating foam 48. The insulating strip 50 between the rear wall 41 and the lateral walls 5, 6 reduces a heat transfer to the lateral walls 5, 6 so that in front of the lateral walls 5, 6, especially when the refrigeration device 1 is built into a fitted unit (not shown) an insulating layer of air can build up which additionally insulates the refrigeration device 1.

Figure 15:
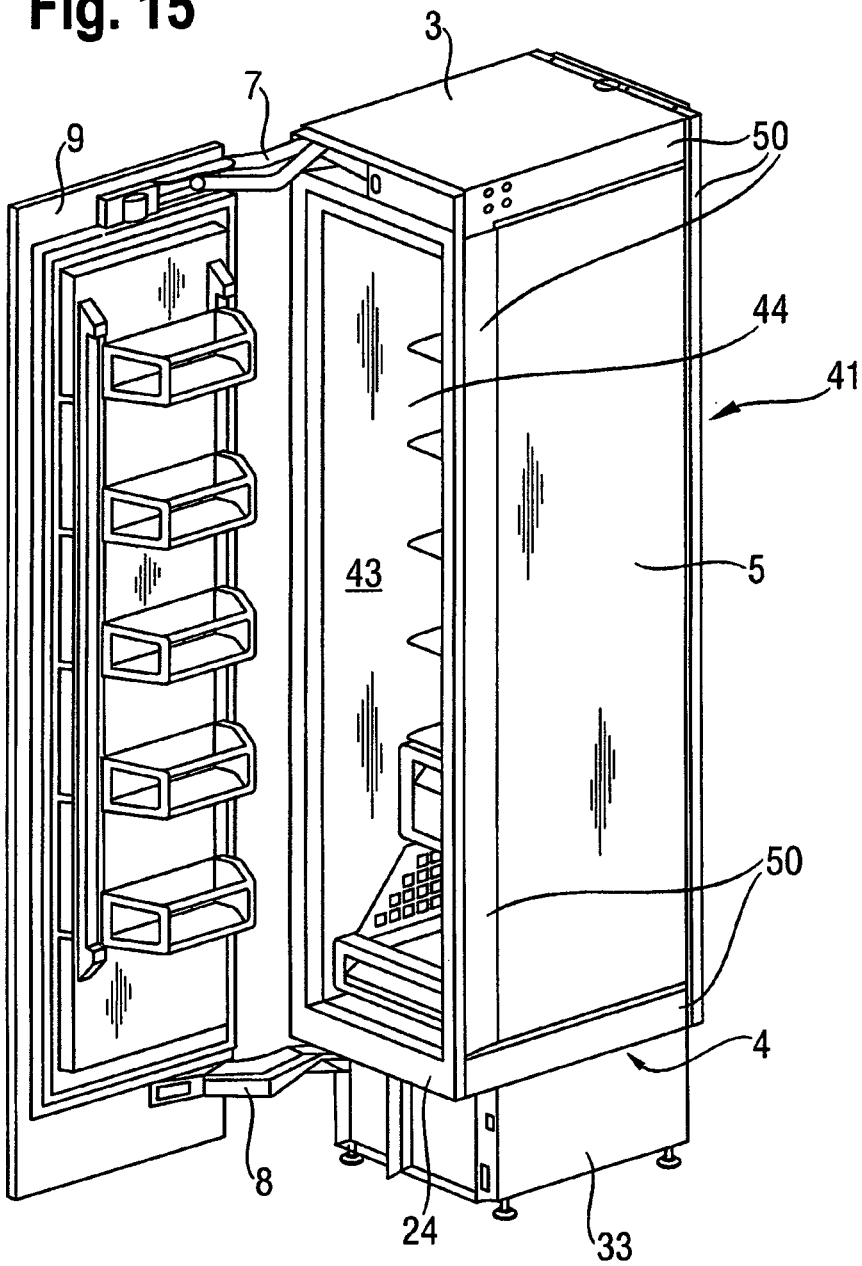

FIG. 15 shows a perspective view of an inventive refrigerator 1, where the lateral walls 5, 6 are thermally insulated from the top 3, the base 4, the rear wall 41 as well as from the inner walls 44 by the insulating strip 50. Heat conducted from the base 4, the top 41 as well as the inner walls 44 through to the lateral walls 5, 6 is significantly reduced by this, with the efficiency of the refrigerator 1 being improved. The insulating strips 50 on the front frame 24 and the lateral walls 5, 6 serve to thermally insulate the reinforcement frame 10 from the lateral walls 5, 6. The reinforcement frame 10 contributes to improving the mechanical stability of the housing 2, especially with a wide and heavy doors 9, by improving the transfer of forces from the door 9 to the housing 2. The second hinge 8 is applied from below in the area of the plinth 33 to the base 4 of the housing 2 which does not to lose any space in the interior 43.

Figure 16:
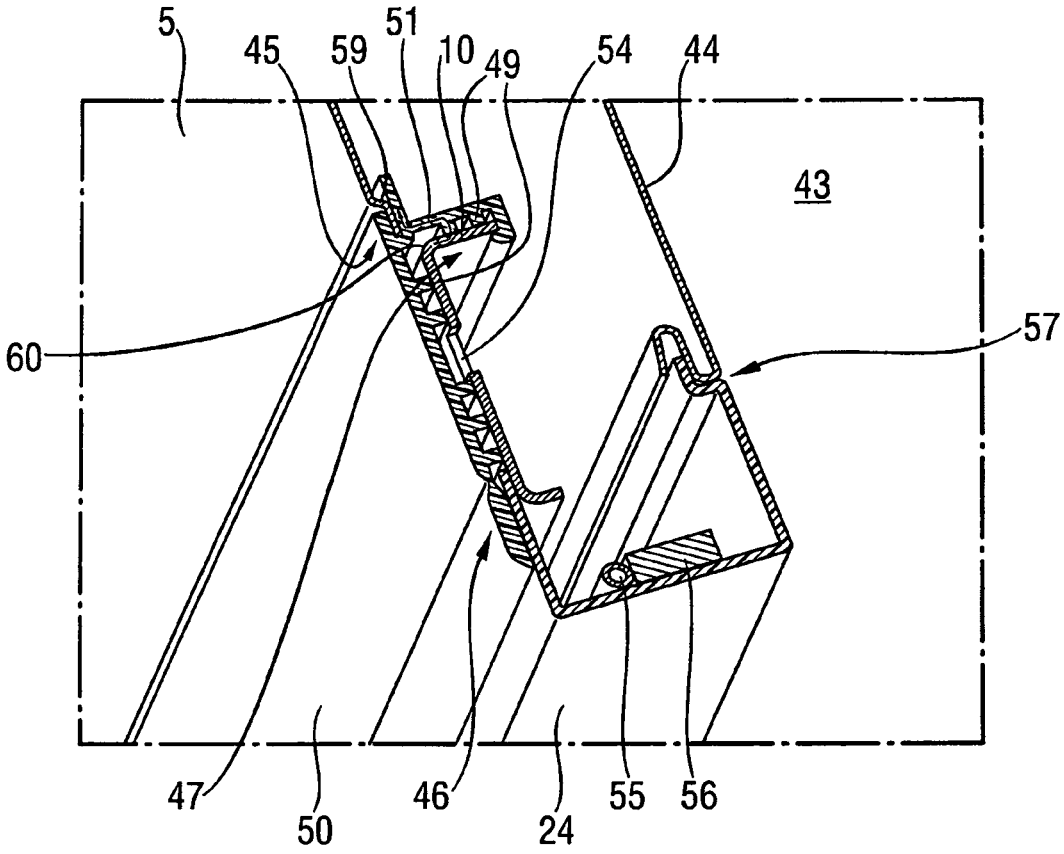

FIG. 16 shows a detailed view of the lateral wall 5 with the reinforcement frame 10 and the insulating strip 50, the front frame 24 and the inner wall 44. The inner wall 44 is connected to the front frame 24 with the aid of a connection element 47 embodied a as groove. The front frame features a heating device 55 and a magnetic strip 56 for closing the door 9. The front frame 24 is made from plastic and is attached with the aid of a second mounting element 46 to the insulating strip 50. The insulating strip 50 is attached with the aid of third mounting element 47 to the reinforcement frame 10, especially clipped on. The insulating strip 50 is attached with the aid of first mounting element 45 to the lateral wall 5. The insulating strip 50 is used in this case to thermally insulate the reinforcement frame 10 from the colder lateral wall 5. For an improved thermal decoupling, support or spacer ribs 49 are provided on the insulating strip which significantly extend a heat-conducting path 51 between the lateral wall 5 and the reinforcement frame 10. Here the heat conducting path 51 between one edge 59 of the lateral wall 5 and a corner 60 of the reinforcement frame 10 is almost doubled, with the heat conduction being correspondingly halved.

Figure 17:
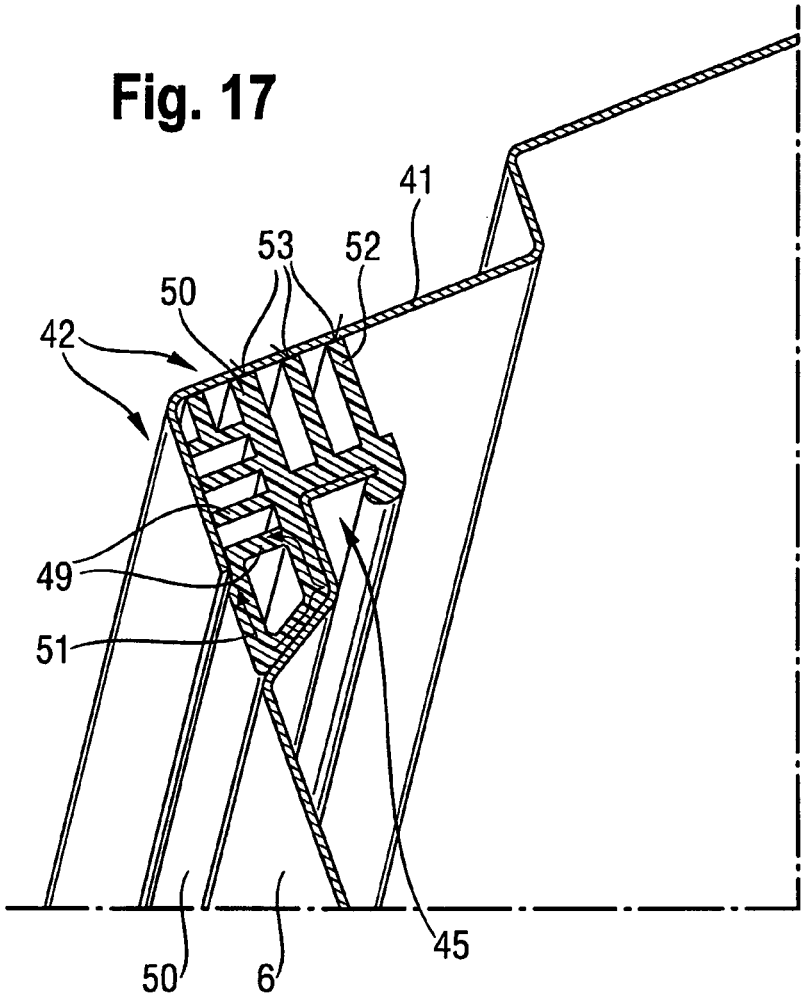

FIG. 17 shows a perspective sectional view of the insulating strip 50 between the rear wall 41 and the lateral wall 6. The insulating strip 50 between the rear wall 41 and the lateral wall 5, 6 is used to better thermally insulate the warmer rear wall 41 from the comparatively colder lateral walls 6, so that an air pillow formed in front of the lateral wall 5, 6 can be used as additional insulation for the housing 2. The insulating strip has support and/or a spacer ribs to further reduce the thermal heat transfer within the insulating strip 50. The support and/or spacer ribs 49 extend the heat transfer path 51 within the insulating strip 50 and thus reduce the heat transfer within the insulating strip 50. The insulating strip 50 also features sealing fins 52 through which the housing 2 is sealed from an escape of insulating foam 48 when the housing 2 is being filled with foam. With the aid of the sealing fins 52 it is possible to simply lay the rear wall onto a mounting surface 53 of the insulating strip and subsequently fill the housing 2 with foam, without the insulating foam 48 penetrating to the exterior. This it is especially advantageous against the background of an installation of the refrigeration device 1 since in this way the rear wall, which is generally heavy, no longer has to be introduced via grooves but can merely be laid on to the housing 2 and foam-filled.

Figure 18:
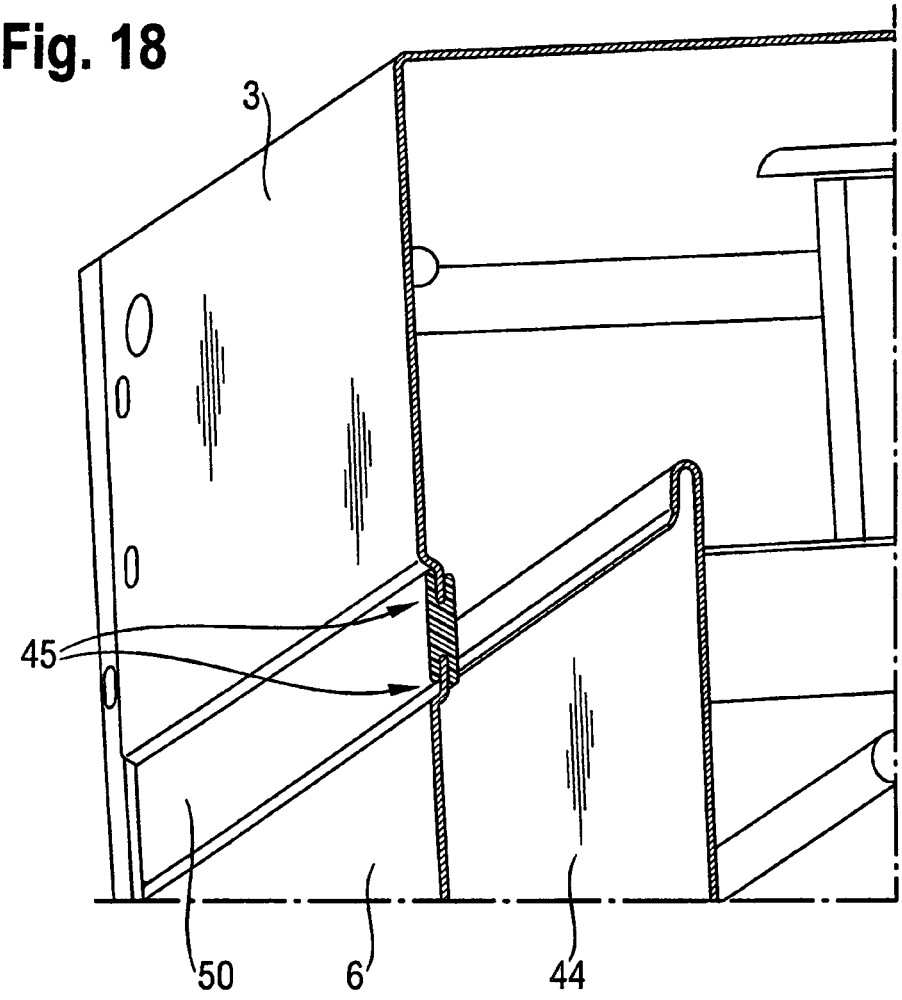

FIG. 18 shows the insulating strip 50 between the lateral wall 6 and the top 3. The insulating strip is connected with the aid of first mounting elements 45 to the top 3 or to the lateral walls 5, 6. Here too the insulating strip 50 is used to thermally insulate the colder lateral wall 5, 6 from the warmer top 3.

Further different aspects which are related to the invention are described below. The individual aspects can each be employed individually, i.e. independently of each other, or combined in a suitable manner in any way with each other and with the aforementioned aspects:

An especially advantageous refrigeration device 1, especially a refrigerator and/or freezer, comprises a housing 2 which features a top 3, a base 4, lateral walls 5, 6 and a rear wall 41 as outer walls 42 and a door 9, an interior 43 located in the housing 2 which is surrounded by inner walls, and a front frame 24 for thermally decoupling the inner walls 44 from the outer walls 42, with the lateral walls 5, 6 being thermally insulated from the other walls 3, 4, 41, 42 by a further insulating strip 50. In this case it is advantageous for the insulating strip to feature a first mounting element 45, especially a groove, for mounting the lateral walls 5, 6, the top 3 or the base 4. In particular of the insulating strip features a second mounting element 46, especially a groove, for mounting the front frame 24. The insulating strip 50 can feature a third mounting element 47, especially a clip element, for mounting a reinforcement frame 10. In this case the reinforcement frame 10 is especially provided for strengthening the housing 2 and the door 9 is attached to the reinforcement frame 10. If is of advantage for the reinforcement frame 10 to feature profile bars 21 which especially feature through-openings 54 for contacting the insulating strip 50 with insulating foam 48. Advantageously support and/or spacer ribs are provided on the insulating strip 50 for reducing the heat transfer between the lateral walls 5, 6 and the other walls 3, 4, 41, 42 or the reinforcement frame 10, with especially a heat transfer path 51 between the lateral walls 5, 6 and the other walls 3, 4, 41, 44 or the reinforcement frame 10 being extended by the support and/or spacer ribs 49 by at least 50%, especially by at least 100%, preferably by at least 200%. There is provision and in an embodiment for sealing fins 52 to be provided on the insulating strip 50 for sealing of the housing 2 while it is being filled with foam in order it to prevent insulating foam 48 escaping to the exterior. It is of advantage for the insulating strip 50 to be arranged between the lateral walls 5, 6 and the front frame 24 and to connect the lateral walls 5, 6 to the front frame 24. Advantageously the insulating strip 50 is arranged between the lateral walls 5, 6 and the rear wall 41, with the insulating strip 50 especially providing a mounting surface 53 for the rear wall 41 so that the insulating strip 50 is partly surrounded by the rear wall 41. In a particular embodiment there is provision for the insulating strip 50 to be arranged between the lateral walls 5, 6 and the top 3 or between the lateral walls 5, 6 and the base 4.

The invention relates to a refrigeration device 1, especially a refrigerator and/or freezer, comprising a housing 2 with a top 3, a base 4, lateral walls 5, 6 and further comprising at least one door 9 attached by hinges 7, 8, with a reinforcement frame 10 being provided on the housing 2, to which the door 9 with the hinges 7, 8 is attached. The invention is characterized in that, with the aid of the reinforcement frame 10 particular mechanical stability of the housing 2 can be achieved, so that even large and heavy doors 9 can be hung to operate safely.

LIST OF REFERENCE SYMBOLS

1 Refrigeration device
2 Housing
3 Top
4 Base
5 First lateral wall
6 Second lateral wall
7 First hinge
8 Second hinge
9 Door
10 Reinforcement frame
11 First mounting
12 Second mounting
13 Pocket
14 Base part
15 Screw plate
16 Box
17 Mounting surface
18 Rear side of box
19 First box side wall
20 Second box side walls
21 Profile bars
22 Corner connector
23 Force distribution element
24 Front frame
25 Hinge box
26 Transverse bar
27 Lower hinge mounting
28 First door side
29 Second door side
30 shelf
31 Door compartment
32 Evaporator
33 Plinth
34 Positioning element
35 Guide pin
36 Threaded hole
37 Locating holes
38 First attachment element
39 Second attachment element
40 Edge
Rear Wall
42 Outer walls
43 Interior
44 Inner walls
45 First mounting element
46 Second mounting element
47 third mounting element
48 Insulating foam
49 Support or spacer ribs
50 Insulating strip
51 heat transfer path
52 Sealing fins
53 Mounting surface
54 Through openings
55 Heating device
56 Magnetic strip
57 Connecting element
58 Contact surface BS70228
59 Edge
60 Corner

The invention claimed is:

1. A refrigeration device, comprising:

a housing having a top, a base and opposing lateral walls, the housing including a refrigeration compartment and/or a freezer compartment to accommodate goods;

a door to permit access to the refrigeration compartment and/or the freezer compartment;

at least one hinge to mount the door to the housing; and a reinforcement frame mounted to the housing, the reinforcement frame being formed of profile bars having a shape corresponding to an access opening of the refrigeration compartment and/or the freezer compartment, the reinforcement frame including at least one mounting having a mounting surface configured for mounting receipt of the hinge, the mounting surface being disposed interiorly of the profile bars and within the shape formed by the profile bars;

wherein the mounting includes at least first and second side walls and forms a pocket configured to at least partially surround the hinge, each of the first and second side walls being directly connected to the profile bars.

2. The refrigeration device according to claim 1 wherein the reinforcement frame is attached to at least one of the top and the base, and the lateral walls.

3. The refrigeration device according to claim 1 wherein the reinforcement frame extends around the housing along the top, the base, and the lateral walls.

4. The refrigeration device according to claim 1 wherein the reinforcement frame includes between two and four mountings for the hinges.

5. The refrigeration device according to claim 4 wherein the pocket of the mounting accommodates from at least about 50% to about 90% of the volume of the hinge.

6. The refrigeration device according to claim 4 wherein the mounting includes a base part and a screw plate, with the base part and the screw plate being connected to form a box, with the box including the mounting surface, with a rear side of the box lying opposite the mounting surface.

7. The refrigeration device according to claim 4 wherein the reinforcement frame includes a first mounting arrangement for hanging the door on a first lateral wall and a second mounting arrangement for hanging the door on a second lateral wall.

8. The refrigeration device according to claim 1 wherein the profile bars include at least one of U-profiles and L-profiles; the reinforcement frame including corner connectors, with the profile bars being connected to each other by the corner connectors.

9. The refrigeration device according to claim 8 wherein the corner connectors feature force distribution elements, through which a force exerted on the reinforcement frame is transferred to the housing, including a force distribution element having a contact surface with the housing and having a surface area of at least between 15 $cm^2$ and at least 50 $cm^2$.

10. A refrigeration device according to claim 1 wherein the reinforcement frame is connected to a front frame of the refrigeration device.

11. The refrigeration device according to claim 10 wherein the reinforcement frame includes a positioning element for positioning the front frame.

12. The refrigeration device according to claim 10 wherein the front frame includes a hinge box.

13. The refrigeration device according to claim 1 wherein the reinforcement frame includes a transverse bar.

14. The refrigeration device according to claim 1 wherein a lower hinge mounting arrangement is provided and configured for attachment from below to the refrigeration device and switched from one door side to another door side.

15. The refrigeration device according to claim 1 wherein the reinforcement frame has a rectangular shape.

16. The refrigeration device according to claim 1 wherein the mounting is entirely disposed in the interior portion of the shape of the profile bars.

17. A refrigeration device, comprising:

a housing including a refrigeration compartment and/or a freezer compartment to accommodate goods;

a door to permit access to the refrigeration compartment and/or the freezer compartment;

at least one hinge to mount the door to the housing; and a reinforcement frame mounted to the housing, the reinforcement frame having a generally rectangular shape corresponding to an access opening of the refrigeration compartment and/or the freezer compartment, the reinforcement frame including at least one mounting having a box configuration disposed interiorly of the reinforcement frame and in a corner area of the rectangular shape, the mounting having a mounting surface configured for mounting receipt of the hinge, wherein the mounting includes at least first and second side walls and forms a pocket configured to at least partially surround the hinge, each of the first and second side walls being directly connected to the reinforcement frame.

18. The refrigeration device according to claim 17 wherein the housing has a top, a base and opposing lateral walls.

* * * * *